United States Patent [19]

Erkki

[11] Patent Number: 5,003,158

[45] Date of Patent: Mar. 26, 1991

[54] ELECTRICALLY HEATED SAUNA OVEN

[76] Inventor: Telamo Erkki, Viitastentie, SF-01810 Luhtajoki, Finland

[21] Appl. No.: 343,804

[22] Filed: Apr. 26, 1989

[30] Foreign Application Priority Data

Aug. 17, 1989 [FI] Finland ..... 883817

[51] Int. Cl.[5] ..... A61H 33/06; H05B 1/02

[52] U.S. Cl. ..... 392/435; 4/524; 219/213; 219/344

[58] Field of Search ..... 219/345, 354, 377, 347, 219/213, 344, 350, 351, 352, 353, 357, 377; 4/524

[56] References Cited

U.S. PATENT DOCUMENTS

| | | | |
|---|---|---|---|
| 2,152,934 | 4/1939 | Trent | 219/345 |
| 4,412,126 | 10/1983 | Brockway | 219/354 |
| 4,415,798 | 11/1983 | Knappe | 219/554 |

FOREIGN PATENT DOCUMENTS

| | | | |
|---|---|---|---|
| 2428233 | 1/1976 | Fed. Rep. of Germany | 219/213 |
| 2577307 | 8/1986 | France | 219/354 |
| 2616289 | 12/1988 | France . | |
| 55-33560 | 3/1980 | Japan | 219/213 |
| 1034723 | 7/1966 | United Kingdom | 219/213 |

*Primary Examiner*—Geoffrey S. Evans
*Attorney, Agent, or Firm*—McGlew and Tuttle

[57] ABSTRACT

An electrically heated sauna oven comprising a housing, a number of stone elements, particularly soap rock elements, and electric resistor elements, and the electric power supplied therein is controlled by means of a control unit. The stone elements are slabs mutually alike slabs of a regular shape, which are adjacently attached to the housing. The housing is formed of a plate-like underlay, which is vertically attached to the sauna wall. The electric resistor elements are fitted inside each stone element.

18 Claims, 1 Drawing Sheet

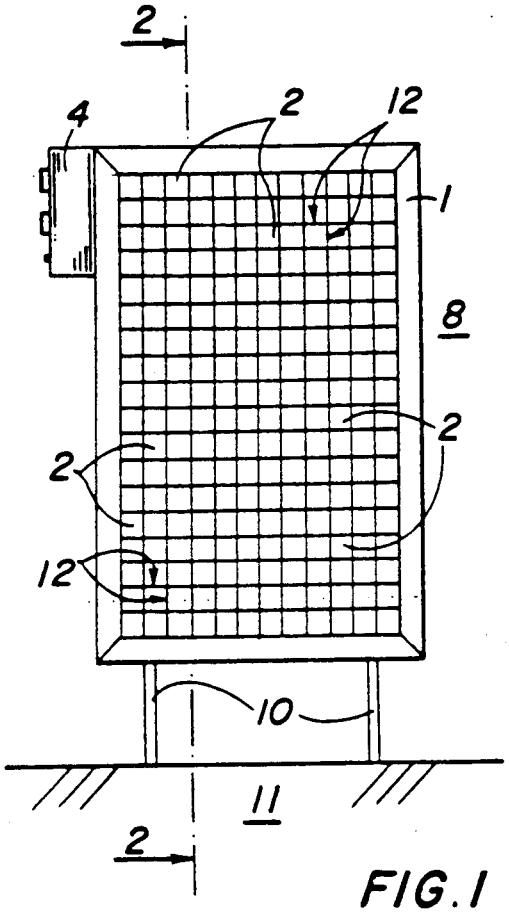
FIG. 1
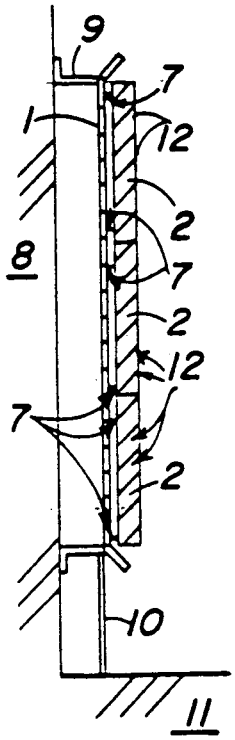
FIG. 2
FIG. 3
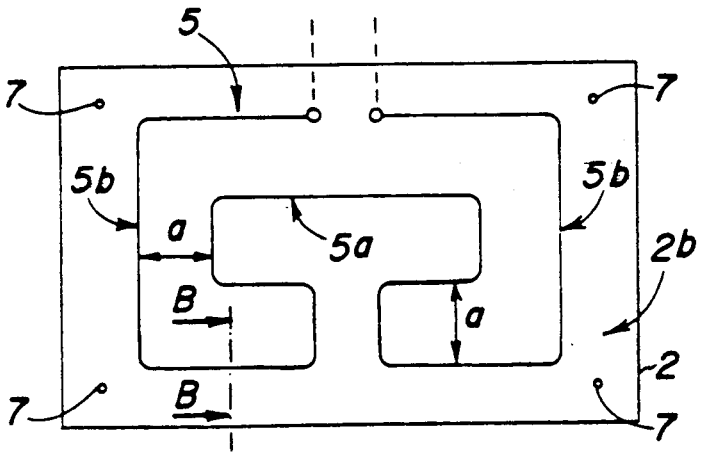
FIG. 4
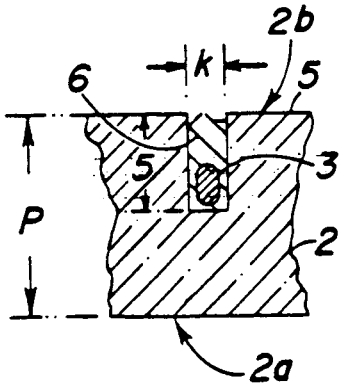

ELECTRICALLY HEATED SAUNA OVEN

The present invention relates to an electrically heated sauna oven which conforms to the introductory section of the independent patent claim.

In the prior art there are known several electric sauna ovens where electric resistor elements are installed inside a box-like housing, and sauna oven stones are arranged in connection with the resistors. The electric resistor elements are heated by means of electric current, and they in turn heat the oven stones proper. When the temperature in the sauna has reached the preset limit, the control unit switches off the current supply to the resistor elements, and after the temperature has declined below a given limit, the control unit reswitches the resistor elements to the network.

Among the drawbacks of the known electrically heated sauna ovens, let us point out the following. The sauna oven requires a determined space both as for the width and the depth. It is difficult to fit a sauna oven in the fairly closed quarters of today. Furthermore, the maintenance of an electrically heated sauna oven may bring about problems. When an electric resistor element is damaged, the oven stones must be dismounted from the top of the elements as well as from between them before the resistors can be reached.

The object of the present invention is to introduce a new type of electrically heated sauna oven whereby the above mentioned drawbacks, among others, can be avoided. In order to achieve this, the electrically heated sauna oven of the invention is characterized by the novel features described in the first patent claim.

The electrically heated sauna oven of the present invention needs little maintenance and is depthwise fitted in a small space. The stone elements, particularly soap rock elements, can be easily replaced when necessary. Generally speaking, the electrically heated sauna oven of the present invention requires extremely little care, is simple in structure and easy to install. Moreover, various sizes of sauna ovens can be constructed by employing different numbers of similar stone elements.

The invention is below explained in more detail with reference to the appended drawings, where FIG. 1 is a front-view illustration of an electrically heated sauna oven of the invention;

FIG. 2 is an illustration of the sauna oven of FIG. 1, seen along the cross-section A—A;

FIG. 3 shows the stone element from below; and

FIG. 4 is an illustration of the element of FIG. 3, seen along the cross-section B—B.

The electrically heated sauna oven of the invention of FIGS. 1 and 2 comprises a housing 1, a number of stone elements 2, particularly soap rock elements, and a number of electric resistor elements 3, whereto electric power is supplied by means of the control unit 4.

The stone elements 2 are slabs which are adjacently fastened to the housing 1. The electric resistor elements 3 are fitted inside each stone element 2. The electric resistor elements 3, six altogether in this embodiment, are switched in pairs coupled in series and connected through the control unit 4 to each phase of a three-phase net. The control unit 4 can be any type of previously known control unit which is used in connection with electrically heated sauna ovens and whereby the resistor elements 3 are connected to the electric network, controlled by means of for instance a thermostat.

In this preferred embodiment the housing 1 is formed of a plate-like underlay which is vertically attached to the sauna wall 8. The housing 1 is provided with fastening supports 9, whereby the fastening to the wall 8 is carried out. If necessary, the housing 1 can also be provided with auxiliary legs 10, which support the sauna oven against the floor 11.

The stone elements 2 are advantageously slabs with a similar form, in this case a regular quadrangle. Thus the stone elements are mutually replaceable, and by using these similar stone elements, various sizes of electrically heated sauna ovens can be compiled by changing the number of the elements.

The front surface 2*a* of the stone elements 2 is advantageously roughed or otherwise made uneven, for instance provided with recesses 12. The purpose of the roughening or other unevenness is to improve the evaporation capacity of the elements—i.e. the rougher the surface, the less water flows down the vertical or inclined surface.

The stone elements 2 are fastened to the housing 1 preferably in a removable fashion. Thus any stone elements that are for one reason or another damaged during use, can be replaced with new equivalent elements. Each stone element can be provided with fastening screws 7, whereby they are fastened to the housing 1.

In the electrically heated sauna oven of the invention, the said stone elements 2 are advantageously soap rock elements. Soap rock is a greyish alteration product of a rock type containing just a little of silicon acid and is mainly composed of talcum and magnesite or dolomite. It is easily workable stone material which endures acids and alkalis relatively well and is fairly resistant to changes in the temperature. In addition to this, soap rock is famous for its excellent heat capacity. Still, it is maintained that other rock types can also be used in the stone elements.

However, very large stone elements 2 cannot be used in the electrically heated sauna oven of the invention, if the material is soap rock. It has been observed that an advantageous size for a square stone slab is 300×300 mm and thickness 30 mm. For instance a 1 kW wire resistor element is easily installed inside such a stone element. If soap rock elements larger in measure are used, they should be supported at the sides for instance by means of compression straps in order to prevent the slabs from breaking by sharp changes in the temperature. When the aforementioned size is used, there is no need for any extra supports for the stone elements.

FIGS. 3 and 4 illustrate how the electric resistor element is fitted inside the stone element 2, which is advantageously a soap rock element. The electric resistor element 3, which is advantageously in the form of wire, is fitted in the groove 5 arranged on the back surface 2*b* of the stone element 2, and the groove 5 is at least partly filled with mortar 6, preferably fire-resistant mortar. The groove which is arranged on the back surface 2*b* of the stone element 2 is relatively narrow and deep in shape. The depth s of the groove 5 is for instance half of the thickness b of the stone element 2, and the width k of the groove is a third of the depth s thereof. It is obvious that these values are only advisory and that remarkable deviations from them are possible without any essential changes in the operation of the stone element.

The groove 5 is arranged to circulate the back surface 2*b* of the stone element in two parallel grooves 5*a*, 5*b*, at a distance a from each other and united to each other.

Advantageously the distance a is constant, but variations are also possible. The purpose is to make the groove 5 and the electric resistor element 3 fitted therein to cover the surface of the stone element 2 as evenly as possible, so that the heat delivered by the resistor element would also spread evenly over the whole stone element.

In FIGS. 1 and 2, the housing 1 of the sauna oven of the invention is realized as a plate-like underlay. The housing 1 can also be realized for instance by means of a partly vertically installed plate-like underlay or by means of an underlay which can at least partly be installed at a sharp angle, i.e. with an angle of inclination which gradually changes when proceeding downwards. On the other hand, it is even possible that the housing is set in an at least partly horizontal position, or that the stone elements fastened thereto are at a deviant angle with respect to the underlay. The electrically heated sauna oven of the invention can be provided with parallel bars or the like extending from top to bottom or from one side to another and serving as safety protection when bathing in the sauna. They prevent the bathers from accidentally falling against the hot stone elements.

In the above description the invention is explained mainly with reference to one preferred embodiment only, but it is naturally clear that the invention can be modified in many ways within the scope of the inventional idea defined in the appended patent claims.

I claim:

1. An electrically heated sauna oven comprising a housing, a plurality of stone elements, and electric resistor elements, and the electric power supplied therein is controlled by means of a control unit, wherein the stone elements are naturally occurring stone slabs which are adjacently attached to the housing and that the electric resistor elements are fitted inside each stone element.

2. The sauna oven of claim 1, wherein a housing is formed of a plate-like underlay.

3. The sauna oven of claim 2 wherein the housing is vertically attached to the sauna wall.

4. The sauna oven of claim 1 wherein the stone elements are mutually alike slabs of a regular shape.

5. The sauna oven of claim 1 wherein the front surface of the stone elements is roughened providing a water-flow resisting surface.

6. The sauna oven of claim 1 wherein the front surfaces of the stone elements is provided with water-retaining recesses.

7. The sauna oven of claim 1 wherein the stone elements are removably attached to the housing.

8. The sauna oven of claim 1 wherein the electric resistor element is fitted in a groove arranged on the back surface of the stone element, and that the groove is at least partly filled with heat-resistant mortar.

9. The sauna oven of claim 8, wherein the groove is narrow and deep in shape, and is arranged to circulate around the plate in two parallel groove portions which are located at a distance from each other and are united at one end.

10. An electrically heated sauna oven comprising a housing, a plurality of stone elements, and electric resistor elements, the electric power supplied therein being controlled by means of a control unit, wherein the stone elements are slabs which are adjacently and removably attached to the housing and that the electric resistor elements are fitted inside each stone element.

11. An electrically heated sauna oven comprising a housing, a plurality of stone elements, and electric resistor elements, the electric power supplied therein being controlled by means of a control unit, wherein the stone elements are slabs which are adjacently attached to the housing and the electric resistor elements are fitted in respective grooves arranged on back surfaces of respective stone elements, each groove being at least partly filled with heat-resistant mortar.

12. The sauna oven of claim 11, wherein the housing is formed of a plate-like underlay.

13. The sauna oven of claim 12 wherein the housing is vertically attached to a sauna wall.

14. The sauna oven of claim 11 wherein the stone elements are mutually alike slabs of a regular shape.

15. The sauna oven of claim 11 wherein the front surface of the stone elements is roughened providing a water-flow resisting surface.

16. The sauna oven of claim 11 wherein the front surface of the stone elements is provided with water-retaining recesses.

17. The sauna oven of claim 11 wherein the stone elements are removably attached to the housing.

18. The sauna oven of claim 11, wherein the groove is narrow and deep in shape, and is arranged to circulate around the plate in two parallel grooves which are located at a distance from each other and are united at one end.

* * * * *